US009739144B2

(12) United States Patent
Kolle

(10) Patent No.: US 9,739,144 B2
(45) Date of Patent: Aug. 22, 2017

(54) FREQUENCY MODULATED MUD PULSE TELEMETRY APPARATUS AND METHOD

(71) Applicant: TEMPRESS TECHNOLOGIES, INC., Renton, WA (US)

(72) Inventor: Jack J. Kolle, Seattle, WA (US)

(73) Assignee: TEMPRESS TECHNOLOGIES, INC., Renton, WA (US)

( * ) Notice: Subject to any disclaimer, the term of this patent is extended or adjusted under 35 U.S.C. 154(b) by 0 days.

(21) Appl. No.: 15/059,059

(22) Filed: Mar. 2, 2016

(65) Prior Publication Data

US 2016/0258287 A1 Sep. 8, 2016

Related U.S. Application Data

(60) Provisional application No. 62/126,928, filed on Mar. 2, 2015.

(51) Int. Cl.
*E21B 47/18* (2012.01)

(52) U.S. Cl.
CPC ..... *E21B 47/18* (2013.01)

(58) Field of Classification Search
CPC ..... E21B 47/18
See application file for complete search history.

(56) References Cited

U.S. PATENT DOCUMENTS

| | | | |
|---|---|---|---|
| 5,138,875 | A | 8/1992 | Booer |
| 6,151,554 | A | 11/2000 | Rodney |
| 7,139,219 | B2 | 11/2006 | Kolle et al. |
| 8,528,649 | B2 | 9/2013 | Kolle |
| 2004/0206170 | A1 | 10/2004 | Chen et al. |
| 2006/0077757 | A1 | 4/2006 | Cox et al. |
| 2006/0109141 | A1 | 5/2006 | Huang et al. |

FOREIGN PATENT DOCUMENTS

| | | |
|---|---|---|
| WO | WO 2014081416 | 5/2014 |
| WO | WO 2014085935 | 6/2014 |

OTHER PUBLICATIONS

Patent Cooperation Treaty, PCT—Search Report and Written Opinion, Mailed May 16, 2016.

*Primary Examiner* — Sisay Yacob
(74) *Attorney, Agent, or Firm* — Morgan, Lewis & Bockius LLP

(57) ABSTRACT

An apparatus and method to improve transmission of mud pulse telemetry signals is described. A mud pulser is placed in series with a water hammer pulse valve. While generating pulse signals, the mud pulser modulates the flow of mud downstream to the pulse valve. The pulse valve, which cycles at a frequency that is proportional to the flow rate through the tool, operates at a frequency that is effectively modulated by the mud pulser. A sensor that may be at the surface receives a mud pulse signal that comprises both an amplitude modulated component as well as a frequency modulated component.

16 Claims, 9 Drawing Sheets

FREQUENCY MODULATED MUD PULSE TELEMETRY APPARATUS AND METHOD

BACKGROUND

Mud pulsers are an integral component of directional drilling and measurement while drilling in downhole oil and gas operations. Mud pulsers use a variable orifice downhole to choke (positive pulser) or divert (negative pulser) the flow of drilling mud though the tool. The pulses are encoded in patterns that include data measured by a measurement-while-drilling (MWD) tool. For directional drilling, information such as azimuth, inclination, and tool face orientation are used to generate a pulse code. One or more pressure sensors at the surface detect the resulting pressure signal and decode it for use in steering the drill. Many other types of data may also be transmitted.

A typical MWD mud pulser generates pressure pulses at 0.5 to 3 Hz. Given the slow transmission rate, the time required to transmit any information can be significant—on the order of minutes per data point. Additionally, a mud pulse signal tends to dissipate as the length of the drill string increases. Pump noise can also interfere with the mud pulse signal, especially when the signal has attenuated during propagation through a long drill string. There is an extensive patent literature describing mud pulse tools and methods of interpreting the signals. For example, U.S. Pat. No. 6,421,298 to Beattie et al. ("the '298 Patent") discloses a method for detecting these signals in the presence of pump noise.

A wide range of mud pulse telemetry systems have been developed. However, the most common systems in use are the basic positive or negative mud pulse systems that rely upon interpretation of the relative amplitude of the mud pressure signal. Tools that modulate the frequency of the mud pulse signal have also been developed. Some tools incorporate a rotary valve with variable rotation rate to modulate the pulse frequency.

There is a need to provide improved mud pulse telemetry that is capable of providing faster data rates and a signal that is more resistant to noise.

SUMMARY OF THE INVENTION

The following invention presents a novel apparatus and method to improve transmission of mud pulse telemetry signals when a mud pulser is configured in series with a water hammer valve. Several novel configurations of a water hammer valve and tool are described in other patents from the assignee. These patents are herein incorporated by reference, U.S. Pat. No. 8,939,217 ("the '217 Patent") and U.S. Pat. No. 8,528,649 ("the '649 Patent") to Kolle, which disclose a downhole water hammer valve that cycles at a constant rate to generate pulses that improve weight transfer to a drill bit and help to move a drillstring forward in a long horizontal hole. U.S. Pat. No. 7,139,219 to Kolle et al., is also herein incorporated herein by reference, and discloses a frequency sweep mechanism for a water hammer valve that is designed to allow decoding of a stacked series of pulses for seismic profiling.

The present invention involves utilizing a water hammer valve in conjunction with a conventional (positive or negative) mud pulser and associated filtering techniques to improve the communication of mud pulse telemetry signals.

BRIEF DESCRIPTION OF THE DRAWINGS

Various aspects and attend advantages of one or more exemplary embodiments and modification thereto will become more readily appreciated as the same becomes better understood by reference to the following detailed description, when taken in conjunction with the accompanying drawings, wherein.

DETAILED DESCRIPTION

The present invention involves supplying a water hammer valve and tool of the type disclosed in the '217, '649, or '219 Patents, or other similar water hammer tools, in conjunction with a conventional (positive or negative) mud pulser. Preferably the water hammer valve is located below the MWD mud pulser in the bottomhole assembly (BHA) but it may also be located above the BHA anywhere in the drillstring.

The water hammer valve configured in various embodiments of the invention is a fluid flow actuated valve that restricts the flow at a periodic rate that is in proportion to the flow rate though the tool and that can generate pulses with an amplitude that is also in proportion to the flow rate through the tool. Thus, the water hammer valve cycle rate is a direct function of flow rate though the tool. Because the mud pulser modulates flow rate as well as pressure, the mud pulse signal will modulate the water hammer cycle rate. A frequency modulated signal typically provides a better signal to noise ratio than an amplitude modulated signal. The combination of the water hammer cycle frequency and the received mud pulse amplitude will provide more information than the amplitude signal alone and will allow improved signal reception. Thus, the amplitude of the MWD signal is used to directly modulate the frequency of the water hammer signal. The correlation of the combination of the water hammer cycle frequency and the received pulse amplitude is such that when the MWD signal amplitude is high, the water hammer valve cycle rate is cycled at a lower frequency. Conversely, when the MWD signal amplitude is low, the water hammer valve cycle rate is cycled at a higher frequency.

Figure 1:
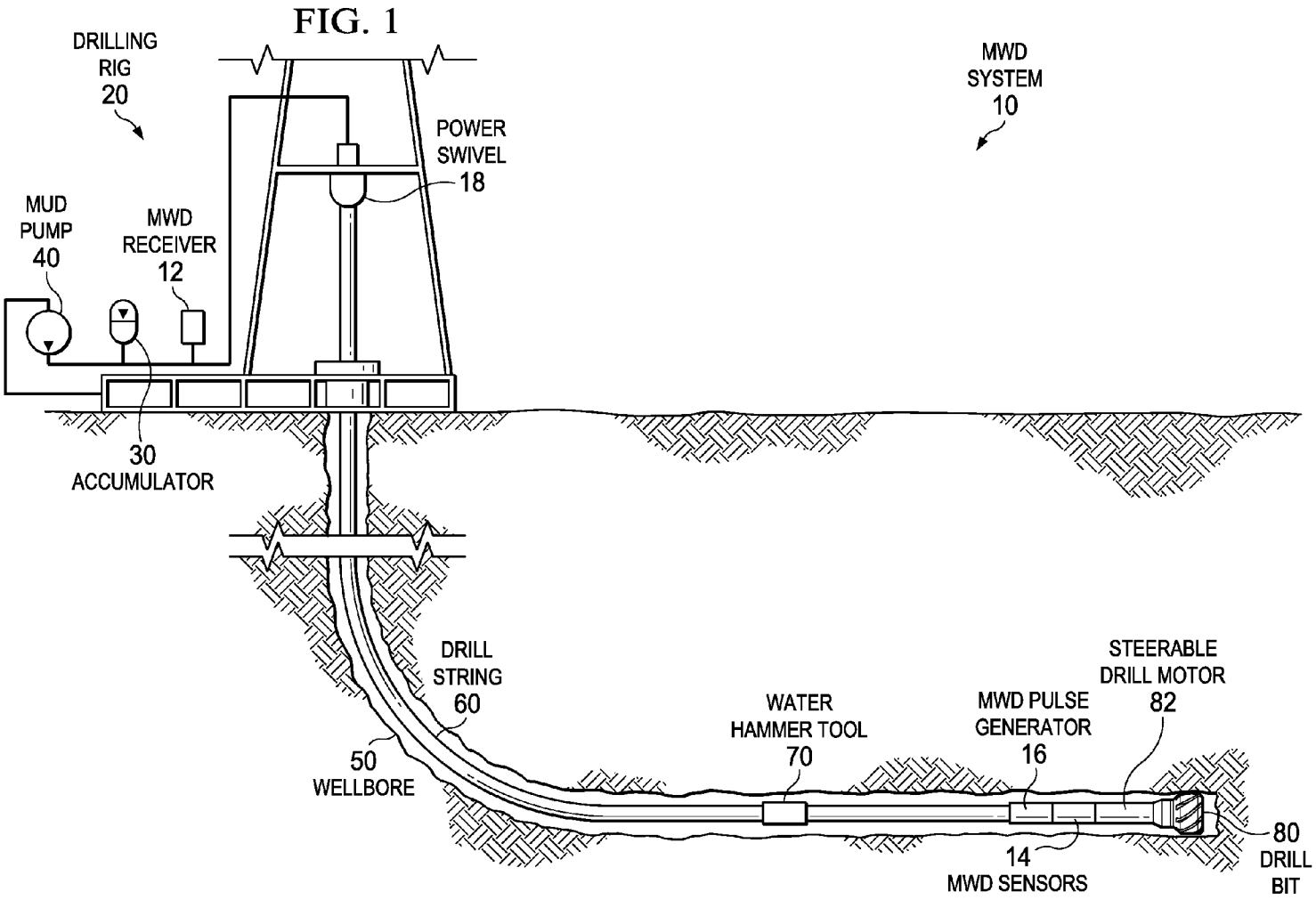
FIG. 1 illustrates a schematic cross-sectional view of an embodiment of a drilling assembly having pulse generator and water hammer tools configured.

Referring to FIG. 1, this figure illustrates an embodiment of a drilling rig 20 assembly having pulse generator and water hammer tools configured. A mud pump 40, typically used with an attached accumulator 30 to reduce pressure fluctuations in the flow line, supplies water or drilling mud through a surface impedance, which may include an orifice or length of tubing to a drillstring which is suspended in a borehole (not shown). A mud pulser 16 is connected to the bottom of the drillstring which includes a drill pipe 60, in a wellbore 50, connected to a power swivel 18. A measurement-while-drilling ("MWD") 14 tool captures downhole measurements such as azimuth, inclination, and orientation. The tool then converts these measurements to a control signal to the mud pulser 16, which encodes the signals for transmission to the surface. In an embodiment, the present invention may include a MWD mud pulse generator 16, MWD sensor 14, drill bit 80, steerable drill motor 82 in a drilling assembly with a water hammer tool 70 located upstream. Mud pulse telemetry is received by a MWD receiver 12 located on surface, preferably downstream of an accumulator 30, which reduces pump pulsations. Those skilled in the art will recognize this as a standard MWD telemetry system with the addition of the water hammer tool 70 in the drillstring.

Figure 2:
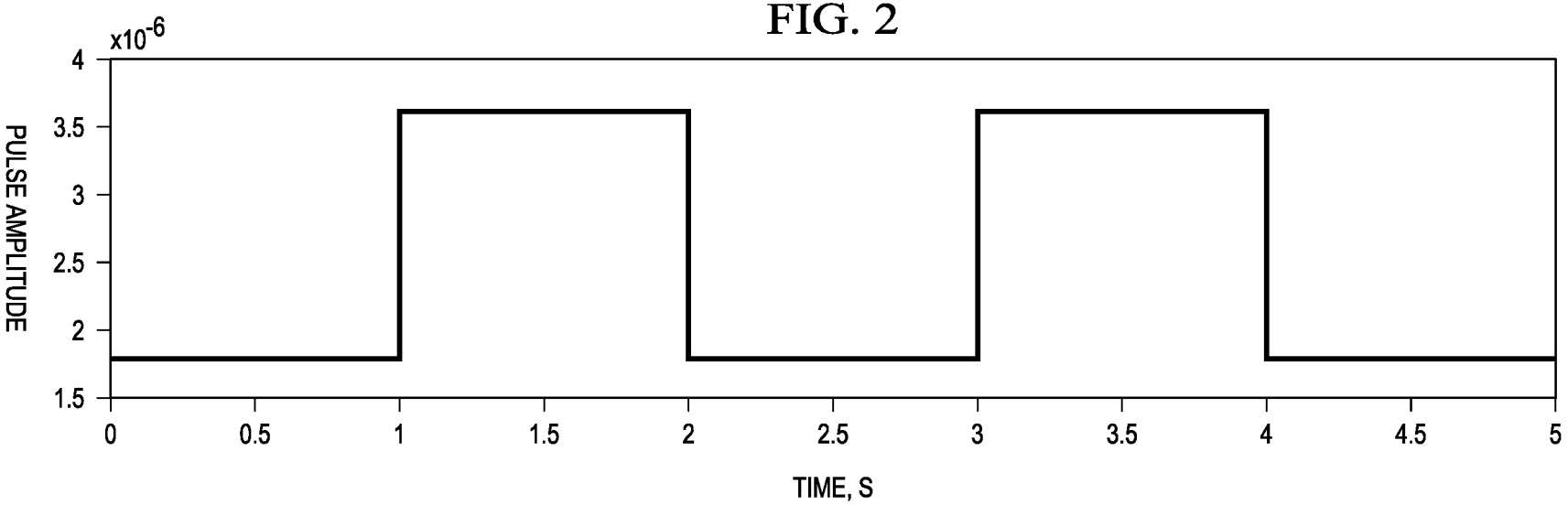
FIG. 2 is an example 0.5 Hz square wave signal as sent to the mud pulser by a measurement while drilling (MWD) tool.

FIG. 2 shows an example 0.5 Hz square wave signal sent to the mud pulser from the measurement while drilling (MWD) sensors. The Y axis is pulse amplitude. FIG. 2 generating at a 0.5 square wave is one of many possible settings for the telemetry signal. A form of pulse code modulation is then sent to modulate the water hammer valve cycle rate based on the square wave sent to the mud pulser. For a positive mud pulser, when the signal is high, the mud pulser valve is fully open and when the signal is low the mud pulser valve is partially closed which reduces flow rate though the tool and causes upstream pressure to increase.

When the mud pulser valve is open, the flow of mud through the mud pulser is not constricted, and the instantaneous flow rate is relatively high. When the valve is closed, the mud flow is constricted, and the flow rate decreases. This in turn directly modulates the water hammer tool cycle rate. When the mud pulser valve is open, the water hammer tool cycles at an increased rate due to increased flow and when the mud pulser valve is closed, the water hammer tool returns to cycling at its configured rate. This in turn has an effect on the noise and modulation introduced into the propagating mud pulser signals. The mud pulser signals benefit from an increase in amplitude introduced by the higher frequency cycling of the water hammer tool as will be discussed further below.

Figure 3:
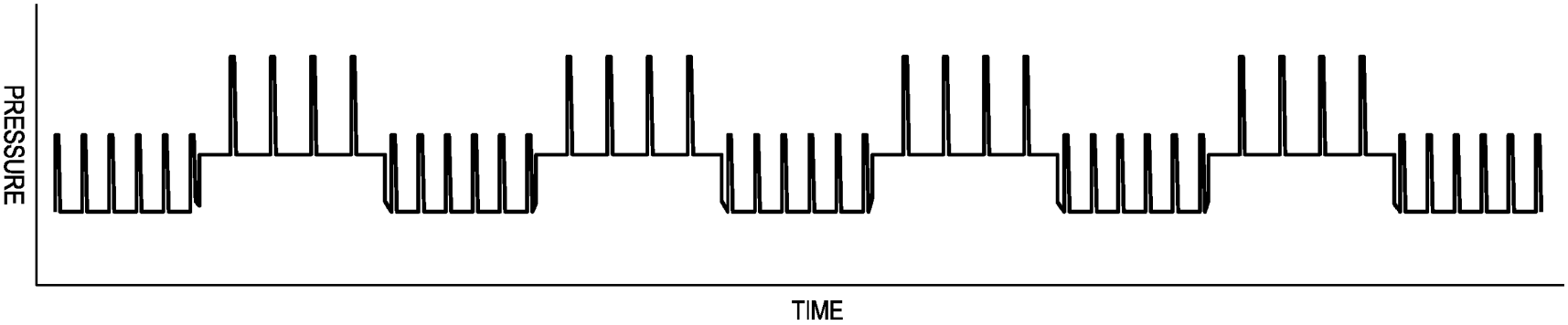
FIG. 3 is a graph that shows an example of an expected pressure signal differential through the water hammer tool generated by the combined mud pulser and water hammer tool.

FIG. 3 shows an example of an expected pressure signal differential through the water hammer tool generated by the combined mud pulser and water hammer tool. The vertical axis represents the upstream pressure of the propagated pressure signal in pounds per square inch (psi). The low frequency component corresponds to low and high pressures upstream of the mud pulser, which are out of phase with the pressure pulse signals upstream of the mud pulser, such that when the mud pulser is open, the upstream pressure decreases and the flow rate increases and as the mud pulser closes, the upstream pressure increases and the flow rate decreases. The water hammer tool generates periodic pressure pulses, and the frequency of the pressure pulses is linearly proportional to the mud flow rate upstream of the water hammer tool. Because the mud pulser cyclically affects the mud flow rate during its operation, the mud pulser effectively modulates the frequency of the pressure pulses generated by the water hammer valve. The mud pulser's low frequency signal serves to modulate the water hammer valve's high frequency signal. In the example shown in FIG. 3, when the mud pulser valve is open, the water hammer tool's cycle rate is about 6 Hz. When the mud pulser is partially closed, the water hammer tool's cycle rate slows to about 5 Hz.

As seen in FIG. 3, the pressure signal generated by the mud pulser and the water hammer valve comprises both an amplitude-modulated component as well as a frequency-modulated component.

Figure 4:
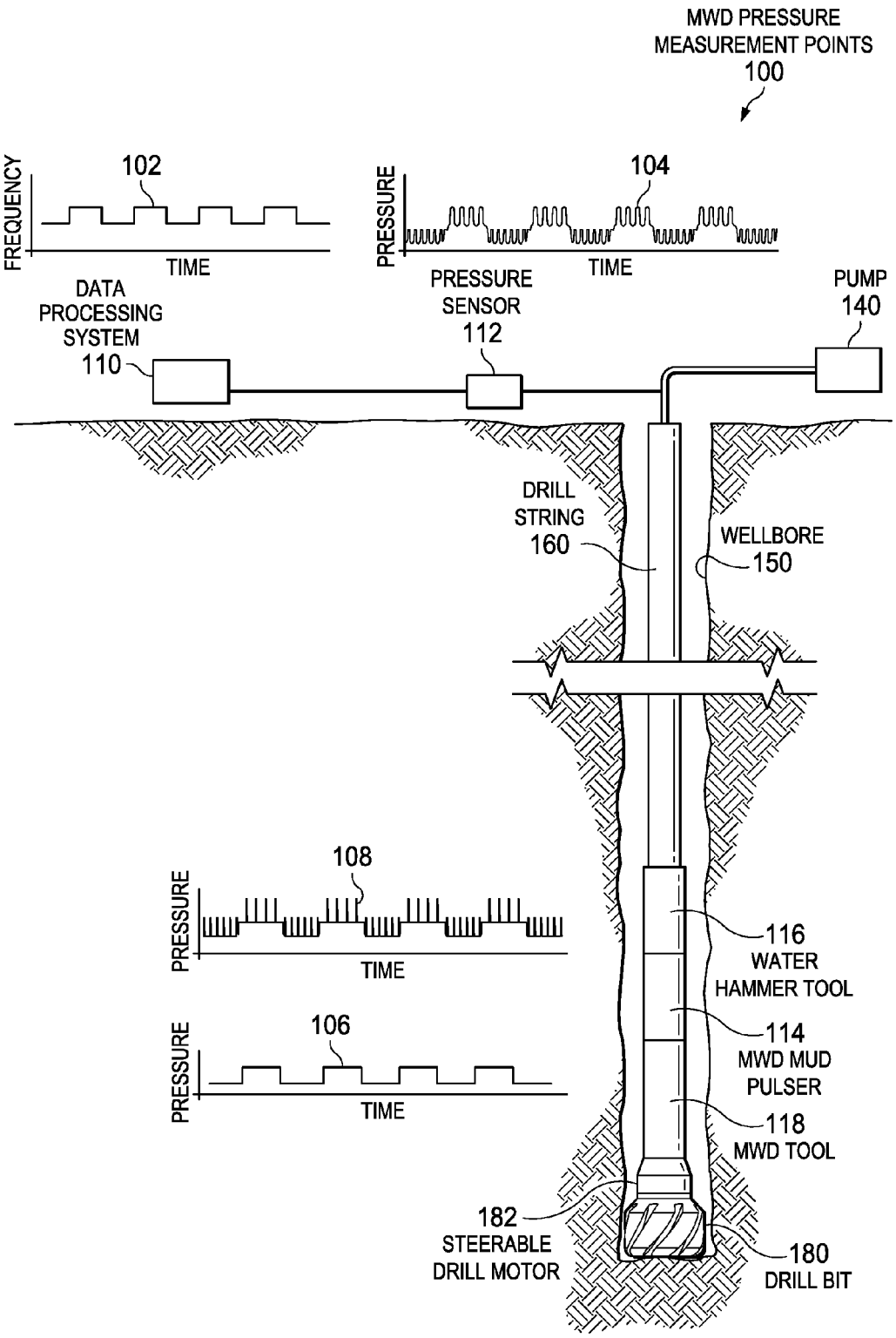
FIG. 4 schematic cross-sectional view of an embodiment of the complete system illustrating signals at various points in the system.

FIG. 4 illustrates an exemplary embodiment of the complete system and the system's associated pressure measurement points. The pressure measurement approach is more conventional than that shown in FIG. 1 and involves a direct measurement of pressure as opposed to differential pressure though an orifice. In this case, a closed pulser 116 generates a positive pressure signal and reduces flow rate. Shown at the surface is a pump 140 that supplies the mud to be pumped through the drillstring. Also at the surface is a pressure sensor 112 that receives pressure signals generated downhole and a data processing system 110 to process the output from the pressure sensor 112. The most common approach is a sensor upstream of the drill pipe and downstream of the pump. A borehole with a drill sting is shown, and at the bottom hole assembly comprises a mud pulser 114, an MWD tool 118, a pulse valve (or a water hammer tool) 116, as well as a steerable drill motor 182 and drill bit 180. The received signal 104 is delayed in time by the time required for the pressure pulses to propagate to the surface, which is about 1.5 s in this case. Both the square wave mud pulser signal and the higher frequency water-hammer signal are apparent in the surface signal. Those skilled in the art will recognize that the water hammer signal frequency may be determined from a short term Fourier transform of obtaining the autocorrelation of the pressure signal with a traveling window with a width on the order of the water hammer cycle period rate. This signal may then be used to regenerate the pulse pattern with a 5 Hz frequency corresponding to high and 6 Hz corresponding to low.

Figure 5:
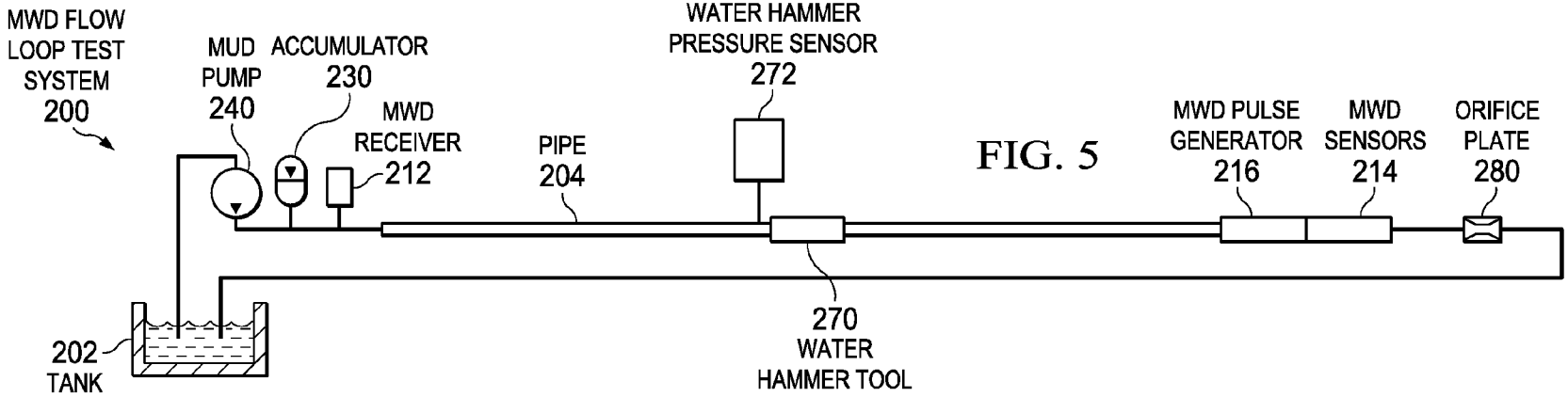
FIG. 5 is a schematic diagram illustrating an example flow loop test configuration.
Figure 6:
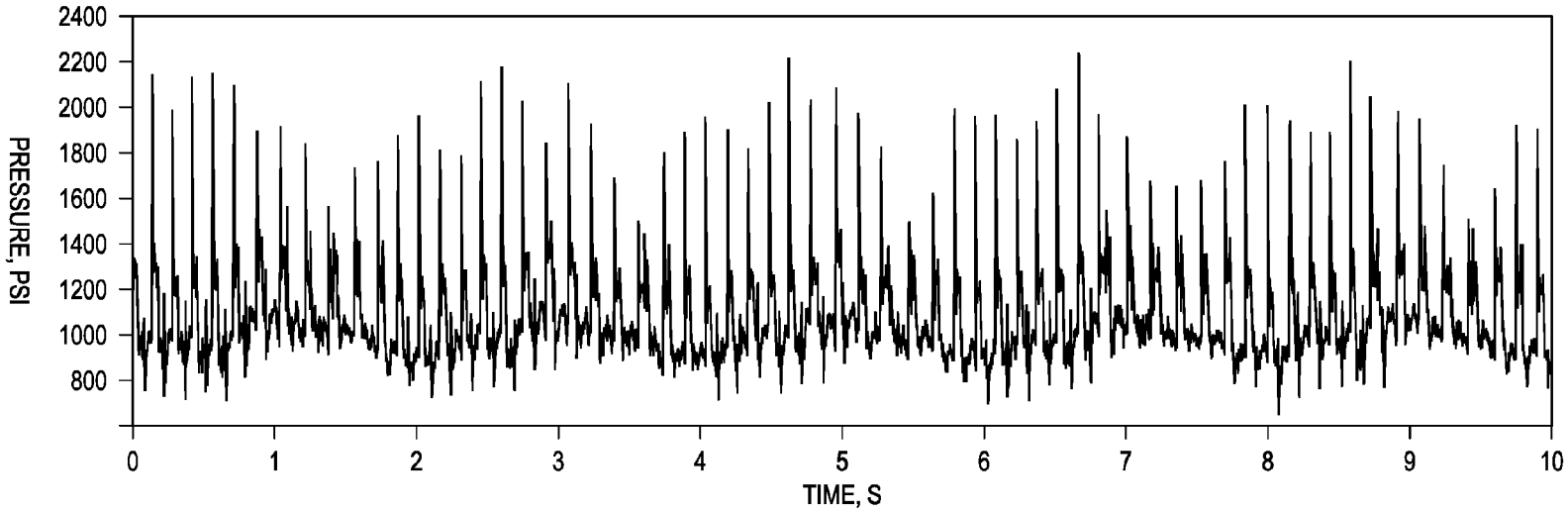
FIG. 6 is a graph showing example water hammer pressure observations as observed during flow loop testing.

As further illustrated by FIG. 4, the graphs adjacent to the mud pulser and pulse valve show the pressure pulses generated by the respective tools. The mud pulser 114 generates an amplitude modulated signal 106, while the water hammer pulse valve 116 generates pressure spikes 108 that vary in frequency in correlation with the mud pulser's signal. At the surface, the graph adjacent to the pressure sensor 112 shows the combined received signal 104, which can then be read by either amplitude or frequency demodulation by the data processing system 110 to arrive at the transmitted signal 102 from the mud pulser. FIG. 5 illustrates a test of the water hammer tool with an MWD mud pulse telemetry tool that was carried out in flow loop 200 consisting of 6000 feet of 4-inch inner diameter ("ID") pipe, as shown in FIG. 5. Also included in the flow loop test system 200 is a mud pump 240, accumulator 230, tank 202, water hammer pressure sensor 272, and orifice plate 280. The testing was done with the water hammer tool 270 located 3000 feet upstream of the MWD tool 216. This configuration simulates operation of an MWD tool 216 with an upstream water hammer tool 270 on the drillstring in a borehole. The MWD mud pulser 216, which can also be referred to a mud pulse generator or mud pulse telemetry source, was operated at a pulse rate of 0.5 Hz in the test described here. FIG. 6 illustrates the water hammer pressure observation in the flow loop of the MWD mud pulse telemetry tool. This reading is measured in the water hammer pressure sensor 272 as labeled in FIG. 5. The y-axis of this graph is pressure measured in psi, and the x-axis is time measured in seconds. The low frequency MWD pulses are seen at 0.5 Hz. Typically mud pulser rates will be configured somewhere between 0.5 Hz and 3 Hz. These pulses modulate the frequency of the high amplitude, higher frequency water hammer pulses—slow when MWD pulser is high and fast when MWD pulser is low.

Figure 7:
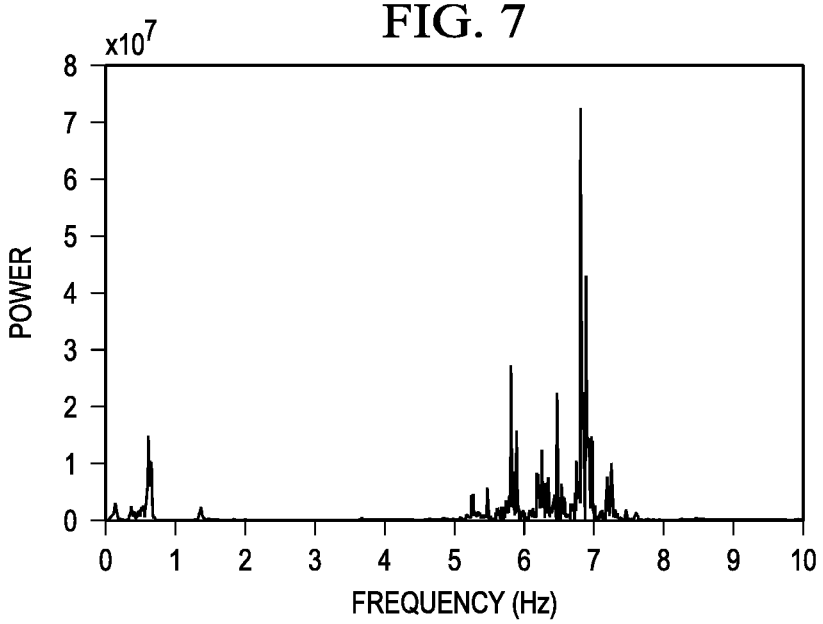
FIG. 7 is a graph showing an example frequency spectrum of the water hammer pressure signal as observed during flow loop testing.
Figure 8:
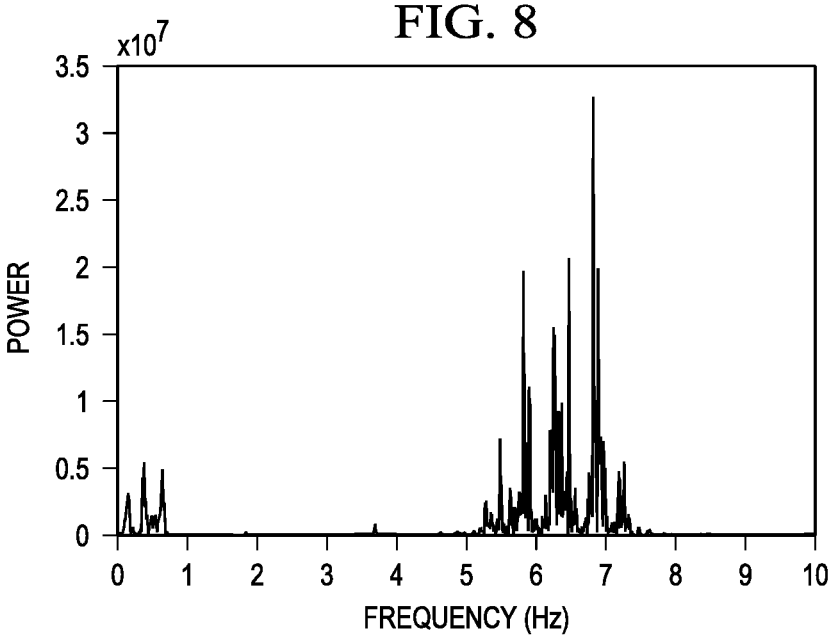
FIG. 8 is a graph showing the measured frequency spectrum of the MWD receiver signal as observed during flow loop testing.
Figure 9:
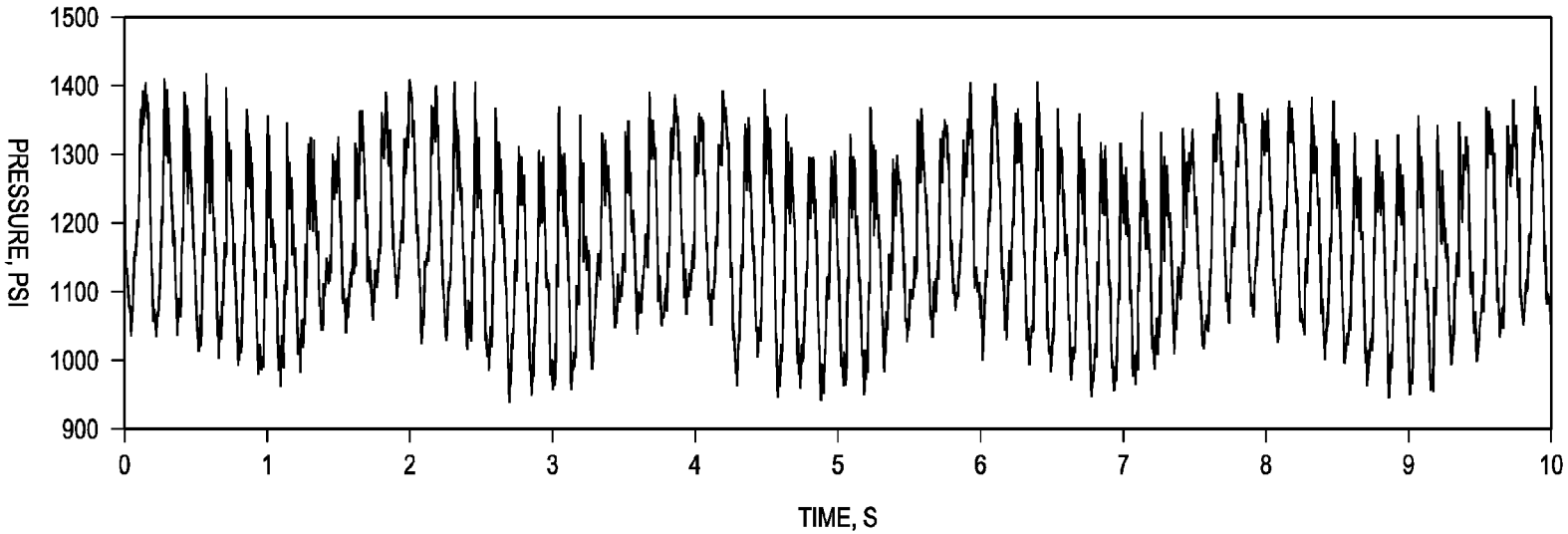
FIG. 9 is a graph showing an example of the MWD receiver signal as observed during flow loop testing.

The horizontal axis is time in seconds. A frequency spectrum of this record, FIG. 6, is shown in FIG. 7. The 0.5 Hz MWD signal is clearly seen. In this embodiment, the frequency of the water hammer pulses is modulated between 5.5 and 7.5 Hz. FIG. 7 illustrates the frequency spectrum of the water hammer tool pressure signal. As stated above, the low frequency MWD pulses are seen at 0.5 Hz. These pulses modulate the frequency of the high amplitude, higher frequency water hammer pulses—slow when MWD pulser is high and fast when MWD pulser is low. In an embodiment, the mud pulser tool may be configured to communicate at pulse rates between 0.5 to 3 Hz. These frequency bands are commonly known in the art. Further, in an embodiment, the frequency of the water hammer pulses may be modulated between 3 and 20 Hz, though the preferable range may be between 5.5 and 7.5 Hz depending on the design and configuration of the water hammer tool and/or other tools configured on the drill string. FIG. 8 shows the measured frequency spectrum of the MWD receiver signal as observed during flow loop testing. For this configuration the MWD signal was at 0.5 Hz and the water hammer signal pulse was modulated between 5.5 and 7.5 Hz FIG. 9 illustrates an example of the MWD receiver signal as observed during flow loop testing during the same time interval as FIG. 6. The frequency modulation is still apparent in this figure, as would be appreciated by one of ordinary skill in the art.

Figure 11A:
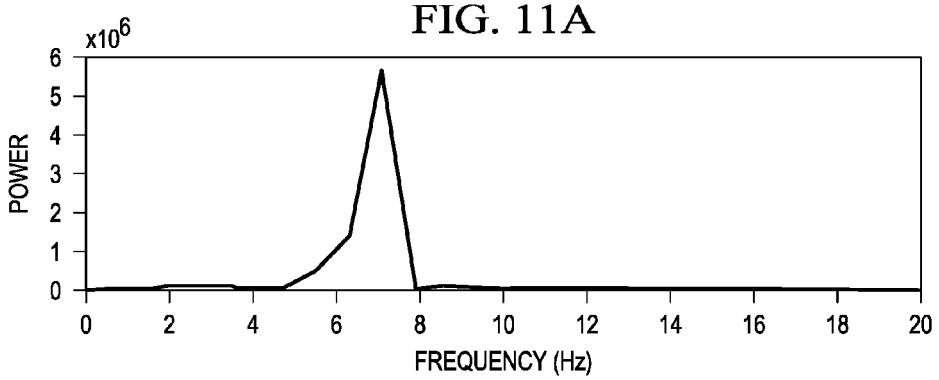
FIGS. 11A-C is a set of figures each showing a short-term spectral analysis of the frequency spectrum of a 1 second window of the record shown in FIG. 9.
Figure 11B:
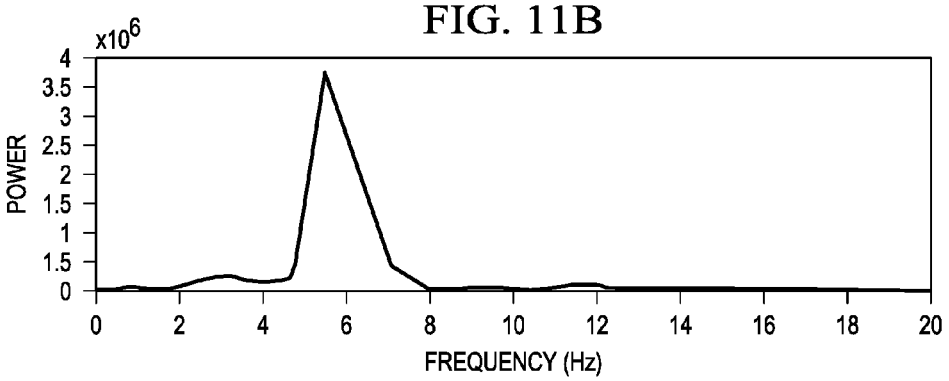
Figure 11C:
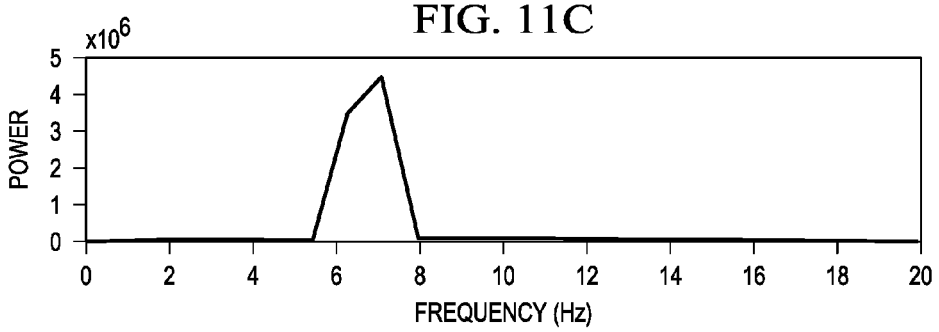

FIGS. 11A-C is a set of figures each showing a short-term power spectral density (PSD) plot of the frequency spectrum of a 1 second window of the record shown in FIG. 9. The change in the dominant frequency corresponds to the mud pulser signal cycling from high to low at 0.5 Hz. FIG. 11A shows the power spectral density of the received signal in the 1 second window of FIG. 8 starting at 0.2 s and ending at 1.2 s. The spectrum has a peak at 7.1 Hz. FIG. 11B shows the short term power spectral density in the subsequent 1 second window showing a 5.5 Hz peak and FIG. 11C shows the subsequent 1 second window. These plots show the frequency modulation of the water hammer pulse signal from 7.1 Hz, which corresponds to mud pulser low, to 5.5 Hz which corresponds to a mud pulser high. This frequency shift can be monitored continuously in time to provide a frequency signal that corresponds to the mud pulser signal.

Note also that the high frequency PSD shown in FIG. 11A and FIG. 11C has higher amplitude than the lower frequency signal shown in FIG. 11B. The PSD amplitude of the water hammer signal shown in FIGS. 11A-C is also correlated with the mud pulse amplitude.

High mud pulser pressure results in lower water hammer pulse amplitude while a low mud pulser signal generates higher water hammer pulse amplitude. This correlation provides a means of amplifying the mud pulser signal. The effect of this amplification is shown in FIG. 13.

Figure 10:
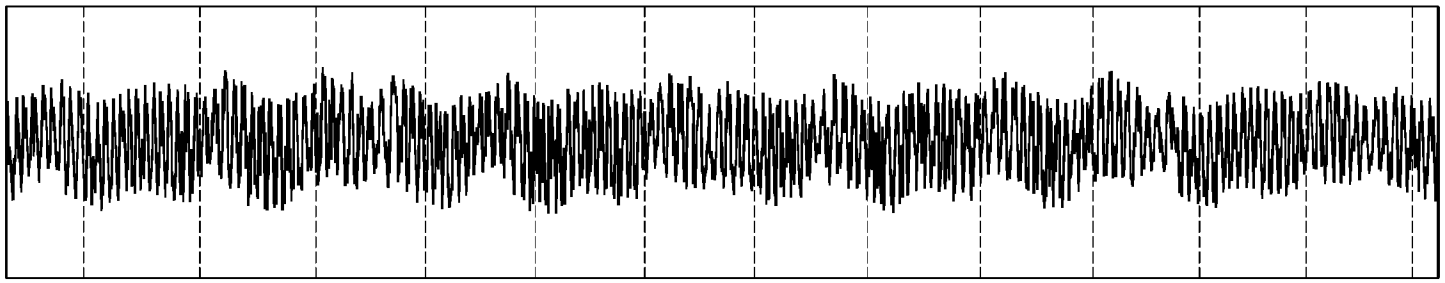
FIG. 10 is a graph showing the measured and unfiltered MWD receiver signal as observed during flow loop testing.
Figure 12:
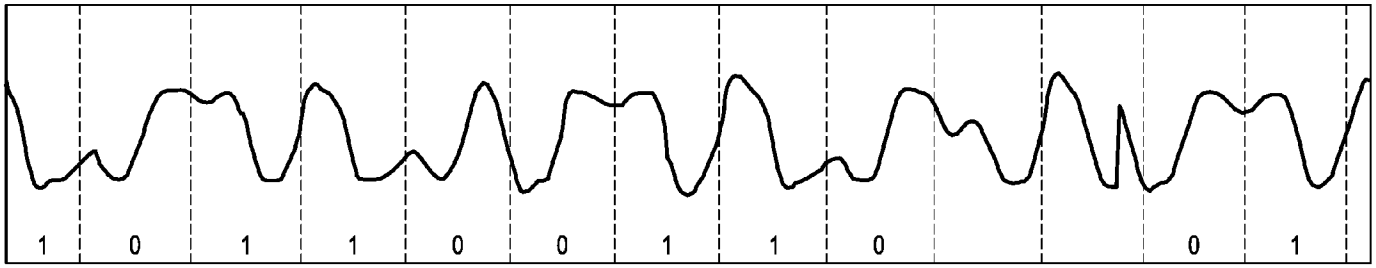
FIG. 12 is a graph showing the measured binary data stream resulting from the application of a lowpass filter applied to the unfiltered MWD receiver signal as observed during flow loop testing.

Another example of a raw MWD signal and lowpass filtered signal are shown in FIG. 10 and FIG. 12, respectively. Low pass filtering removes the higher frequency water hammer pulses and allows interpretation of the MWD signal telemetry. In this case a change from low to high indicates a 0 bit and a change from high to low indicates a 1 bit. This binary signal encodes the MWD sensor data.

The amplitude of the filtered signal determines whether the binary data can be decoded. A plot of the amplitudes of the signal as a function of flow rate for a test with a water hammer tool in line and without a water hammer tool are provided in FIG. 13. The amplitude of the filtered MWD signal is significantly higher when the water hammer tool is run. In this case the MWD signal was decoded at all flow rates when the water hammer tool was run but it was not possible to decode the signal when the MWD system was run without the water hammer tool at the lowest flow rate tested. The water hammer tool provides a significant amplification to the MWD signal.

Figure 13:
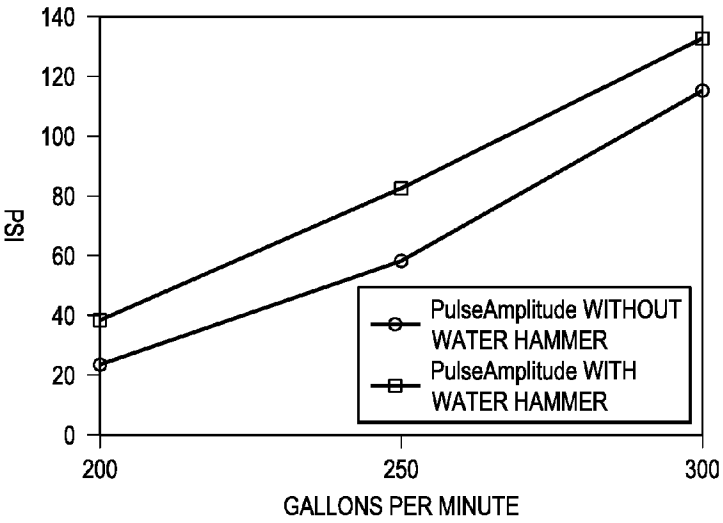
FIG. 13 is a graph showing an example of the MWD pulse amplitude versus flow rate, with and without the water hammer tool.

As shown in FIG. 13, the ability to modulate the amplitude of the water hammer tool directly based on the frequency of the pulser signal has several benefits. This direct modulation can increase the overall amplitude of pulser signal being propagated. This will in turn provide the possibility for a longer propagation distance of the signal and may also provide a clearer surface signal by providing higher amplitude signals depending on the distance traveled. The ability for signals to propagate farther for a given mud pulser configured with an activated water hammer tool will allow for signals to reach surface sensors from longer distances and deeper depths than before.

For a typical mud pulser that operates alone, the mud pulser's frequency and data rate are limited by a variety of noise signals from various sources including the pumps, mud motor, and even rotation of the drillstring. The frequency and amplitude modulation component provided by the water hammer valve provides alternate signal processing methods that are less sensitive to these noise signals, which in turn, would allow a mud pulser to operate at faster pulse rates to achieve higher data rates.

The embodiments presented here are exemplary and are not meant to be limiting. Other configurations may be possible, and the configurations shown herein are not meant to be limiting. Although the concepts disclosed herein have been described in connection with the preferred form of practicing them and modifications thereto, those of ordinary skill in the art will understand that many other modifications can be made thereto. Accordingly, it is not intended that the scope of these concepts in any way be limited by the above description.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

What is claimed is:

1. A mud pulse telemetry system disposed on a drillstring and comprising:

a mud pulser with a control input configured to generate pulse signals of varying amplitude such that the variations in amplitude are used to communicate encoded patterns reflecting certain downhole measurements, said pulse signals being generated at a first frequency; and a water hammer tool configured to generate pulse signals at a second frequency that is higher than the first frequency, wherein the second frequency is modulated based on the amplitude of the pulse signals generated by the mud pulser.

2. The system of claim 1, wherein the second frequency is proportional to a flow rate of the mud through the drillstring.

3. The system of claim 1, wherein the first frequency is between 0.5 to 3 Hz.

4. The system of claim 1, wherein the second frequency is between 3 to 20 Hz.

5. The system of claim 1, further comprising a receiver on the surface configured to evaluate the frequency of a pressure signal received at surface, the pressure signal comprising a combination of the pulse signals generated by the mud pulser and the pulse signals generated by the water hammer tool.

6. The system of claim 5, further comprising a lowpass filter to separate the pulse signals generated by the mud pulser from the pulse signals generated by the water hammer tool.

7. The system of claim 5, wherein the receiver is further configured to evaluate the pulse signals generated by the mud pulser using short term spectral analysis to provide a time series of frequency.

8. The system of claim 5, wherein the receiver is further configured to evaluate the pulse signals generated by the mud pulser using short term spectral analysis to provide a time series of power spectral density.

9. The system of claim 1, wherein the mud pulser and water hammer tool are configured such that the second frequency is correlated with the first frequency.

10. The system of claim 1, wherein the mud pulser and water hammer tool are configured such that the amplitude of the water hammer tool pulses are correlated with the amplitude of the mud pulser signal pulses.

11. A method of measuring mud pulse telemetry signals, comprising:

generating, with a mud pulser, pulse signals of varying amplitude such that the variations in amplitude are used to communicate encoded patterns reflecting certain downhole measurements, said pulse signals being generated at a first frequency; and generating, with a water hammer tool, pulse signals at a second frequency that is higher than the first frequency and modulating said second frequency based on the amplitude of the pulse signals generated by the mud pulser.

12. The method of claim 11, further comprising:

receiving at the surface a pressure signal comprising a combination of the pulse signals generated by the mud pulser and the pulse signals generated by the water hammer tool; and evaluating the pressure signal to derive the pulse signals generated by the mud pulser.

13. The method of claim 11, further comprising using a lowpass filter to separate the pulse signals generated by the mud pulser from the pulse signals generated by the water hammer tool.

14. The method of claim 11, wherein the first frequency of the pulse signals generated by the mud pulser is between 0.5 to 3 Hz.

15. The method of claim 11, wherein the second frequency of the pulse signals generated by the water hammer tool is between 3 to 20 Hz.

16. A method for measuring mud pulse telemetry signals, comprising:

receiving at the surface a pressure signal comprising a pulse signal generated by a mud pulser and a pulse signal generated by a water hammer tool, wherein the frequency of the pulse signal generated by the water hammer tool is modulated based on the amplitude of the pulse signal generated by the mud pulser; and demodulating the pressure signal received at the surface by utilizing a lowpass filter to separate the pulse signals generated by the mud pulser from the pulse signals generated by the water hammer tool.

* * * * *